United States Patent [19]

Pomero

[11] Patent Number: 4,982,931

[45] Date of Patent: Jan. 8, 1991

[54] PROCESS AND DEVICES FOR RETAINING VEHICLES ON A HIGHWAY

[76] Inventor: Claude A. Pomero, 14 Avenue du 22 Août 1944, 34500 Beziers, France

[21] Appl. No.: 351,954

[22] Filed: May 15, 1989

[30] Foreign Application Priority Data

May 20, 1988 [FR] France ..... 88 06907

[51] Int. Cl.[5] ..... A01K 3/00

[52] U.S. Cl. ..... 256/13.1; 256/19; 404/7

[58] Field of Search ..... 256/13.1, 19; 384/910, 384/908, 907.1; 404/7, 8

[56] References Cited

U.S. PATENT DOCUMENTS

| | | | |
|---|---|---|---|
| 1,464,569 | 8/1923 | Guptill | 384/907.1 X |
| 2,156,803 | 5/1939 | Cooper et al. | 384/910 |
| 2,279,942 | 4/1942 | Hausherr . | |
| 3,317,189 | 5/1967 | Rubenstein | 256/13.1 |
| 3,519,249 | 7/1970 | Nave . | |
| 3,658,300 | 4/1972 | Templeton . | |
| 4,222,552 | 9/1980 | Matteo | 256/13.1 |
| 4,666,787 | 5/1987 | Bickle et al. | 384/908 X |

FOREIGN PATENT DOCUMENTS

| | | | |
|---|---|---|---|
| 1917931 | 10/1970 | Fed. Rep. of Germany | 256/13.1 |
| 328685 | 5/1958 | Switzerland | 404/8 |

OTHER PUBLICATIONS

Search Report—FR8806907.

*Primary Examiner*—Andrew V. Kundrat
*Attorney, Agent, or Firm*—Ladas & Parry

[57] ABSTRACT

This invention relates to safety devices placed on the side of highways, of the barrier, rail or curb type, comprising a continuous strip parallel to the road and exposed to the shocks of the vehicles, intended for retaining the latter, which continuous strip bears a solid or pasty sliding coating, for example a coating of polytetrafluoroethylene or a solid silicone resin, or a layer of a paraffin wax or of micronized graphite, or a layer of grease.

10 Claims, 6 Drawing Sheets

8
1
1i
3
4
II
6
5
2
II 8
1
7
4
6
1i
1e
3
2
4a
5

PROCESS AND DEVICES FOR RETAINING VEHICLES ON A HIGHWAY

FIELD OF THE INVENTION

The present invention relates to a process for retaining vehicles on a highway and to safety devices implanted along highways or motorways, either on the shoulder, between the two carriageways of a motorway, or on the highway itself in order to indicate and protect roadworks.

BACKGROUND OF THE INVENTION

Several categories of safety devices implanted along highways exist at the present time.

A first category is that of slide rails or safety rails deformable in the event of shock, which are generally constituted by metallic sections.

A second category is that of safety barriers constituted by low walls made of reinforced or pre-stressed concrete which undergo neither deformation nor displacement in the event of a shock of a vehicle.

A third category is that of conventional roadside curbs.

Safety rails attempt to slow down a vehicle out of control by absorbing its kinetic energy by deformation of the rail, but this effect is inefficient as soon as the mass and/or speed of the vehicle are high. The safety rails are dangerous for motocyclists who strike them.

The metal-on-metal friction at the moment of the shock creates a very strong deceleration and a transfer of energy towards the rail which compromises the resistance and efficiency thereof.

Safety barriers are very efficient to avoid a vehicle accidentally leaving the highway. On the other hand, they are very aggressive for the vehicle since the kinetic energy of the vehicle is absorbed by the crushing of the bodywork. Concrete safety barriers are expensive and they are long to install. Moreover, a vehicle which strikes a safety barrier overturns since the front wheels scale the wall due to the high coefficient of friction of the tires on the concrete. For the same reason, out-of-control vehicles often scale the concrete curbs.

U.S. Pat. No. 3,658,300 (TEMPLETON) describes safety devices for highways which are composed of steel sheets which comprise one or two concave lateral sides of which the lower edge is extended by a substantially horizontal apron placed on the ground. The aprons comprise on their rear face anchoring means which are embedded in the ground.

German publication No. DE A 2 148 219 (MEUGE) describes safety rails for highways which comprise an endless band which is connected to a fixed support by vertical rollers or by balls.

U.S. Pat. No. 3,519,249 (NAVE) describes safety rails which comprise a steel section placed on support posts. This section bears on its face turned towards the highway a deformable trough which contains a lubricating oil. In the event of shock by a vehicle, the oil lubricates the surfaces of the vehicle and of the rail which are in contact with each other, this facilitating slide of the vehicle against the rail.

U.S. Pat. No. 2,279,942 (HAUSHERR) describes safety devices .for highways of which the material has not been specified. These devices comprise, towards the road, a concave side and, to the rear, a vertical wall. This side and wall define a space in which is housed a longitudinal tank which contains an oil. Wicks passing through ports in the concave side are immersed in the oil and continuously pour drops of oil on the concave side.

Swiss Patent No. CH A 429 806 (BUCHER) describes safety devices for highways which comprise a rail made of concrete, steel or a light metal, which is connected to the supports by a damping device constituted for example by a spring or by easily deformable concentric tubes or by stirrup-shaped elements filled with a cellular body. The rails may be combined with curbs presenting a concave surface. These prior art documents show that it is known to lubricate with an oil the contact surface between a vehicle and the rails in order to reduce the coefficient of friction. However, the use of a lubricant liquid, although known, has few practical applications as difficulties in implementation are encountered.

If a tank and wicks, which permanently distribute the oil, are used, the consumption of oil is high unless it is recovered and recycled, which involves expensive installations.

If, as proposed in U.S. Pat. No. 3,519,249, a deformable trough located against the inner face of the rail is used, at the spot where the vehicle strikes, this trough, on breaking, creates roughness which risks blocking the crashed vehicle, instead of providing optimum slide, and fragments may injure the occupants of the vehicle. Moreover, the instantaneous projection of the oil at the location of the shock is random.

SUMMARY OF THE INVENTION

It is an object of the present invention to provide means for facilitating slide of the crashed vehicles against the safety rails, barriers or curbs placed along the highways and motorways, which means are easier and less expensive to employ than lubricating liquids and are permanent.

The means according to the invention comprise the placing along a highway of barriers, rails, curbs, round timber rails or low walls forming a continuous surface substantially parallel to the axis of the road in order to avoid the vehicles accidentally leaving the highway.

The object of the invention is attained by a process whereby a strip of the continuous surface exposed to the shocks of the vehicles is coated with a solid or pasty sliding coating having a static coefficient of friction with rubber lower than 0.4, with the result that a vehicle which accidentally strikes said continuous surface slides along said strip.

A device according to the invention comprises a continuous sliding coating strip parallel to the road, which sliding coating is composed of a solid or pasty material having a static coefficient of friction with rubber less than 0.4.

According to a first embodiment, the sliding coating is composed of polytetrafluoroethylene or a solid silicone resin.

According to another embodiment, the sliding coating is constituted by a layer of graphite particles applied by friction against said surface exposed to shocks.

According to another embodiment, the sliding coating is a layer of wax or paraffin composed of a solid alkane having a number of carbon atoms higher than 15.

According to another embodiment, the sliding coating is a paint or a grease containing particles of graphite or of molybdenum sulfide.

According to another embodiment, the sliding coating comprises micro-balls having a diameter less than 3 mm fixed by a solid binding agent, for example by a film of glue.

The invention results in novel safety devices for highways.

The devices according to the invention present the following advantages:

-They are permanent.

-In the event of accidental shock of a vehicle against the safety device, the vehicle slides easily along the sliding coating, progressively losing its kinetic energy. This results in increased safety for the occupants of the vehicle due to the absence of crushing and/or overturning of the vehicle, as well as a reduction in the material damage for the vehicle.

Moreover, the vehicle which slides along the sliding coating is guided thereby and it may return parallel to the road, this avoiding it passing into the oncoming-traffic carriageway of a motorway or it being returned towards the lane in which it was circulating, hence a reduction in the risk of violent shock with the other vehicles.

A motorcyclist who accidentally strikes a safety device according to the invention slides against the sliding coating and the injuries suffered are less serious.

The solid or pasty sliding coatings according to the invention present the advantage, over the known devices comprising means for applying a liquid lubricant on the surface exposed to the shock, either at the moment of a shock or permanently, of being easier to employ, of being much less expensive to exploit and of also being more aesthetic and more discrete. The same applies with respect to the known devices comprising an endless band mounted on rollers or balls.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
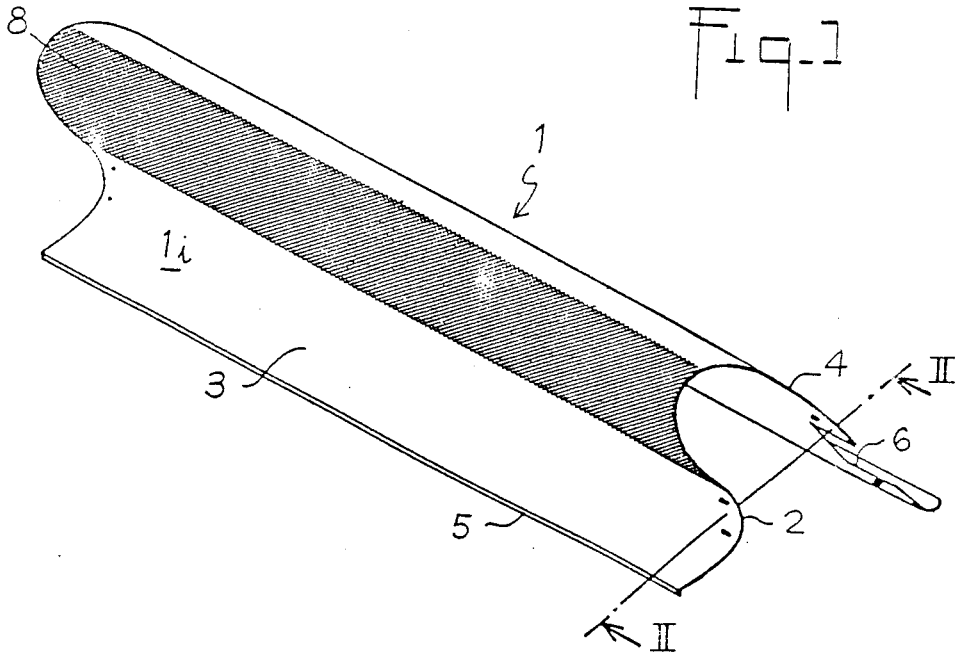
FIG. 1 is a view in perspective of a section of metallic profile used as safety rail along a highway.
Figure 2:
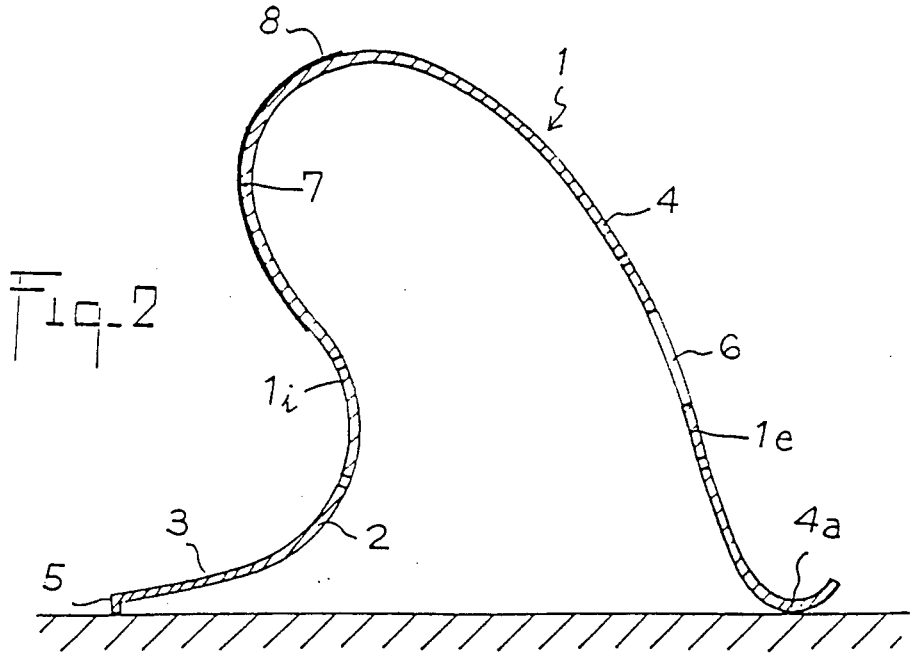
FIG. 2 is a transverse section along II—II of the profile of FIG. 1.

Referring now to the drawings, FIGS. 1 and 2 represent an element 1 of a safety border which is constituted by identical elements simply placed end to end along a highway in order to avoid the vehicles leaving the road.

This element is a profile, for example a metallic profile obtained by rolling, centering or bending a metal sheet.

It comprises two lateral side elements: an inner side li which faces the road and an outer side le which lies on the side opposite the road.

The inner side li is extended downwardly by a sole 3 descending slightly towards the road.

The inner edge 5 of the sole 3 is bent at right angles and abuts on the ground.

The sole 3 is connected to the inner side li by a curved surface 2 whose concavity faces the road.

The transverse width of the sole 3 varies depending on the applications.

According to one embodiment, the sole 3 has a transverse width of the order of 20 cm so that the wheels of a moving vehicle which leaves the highway making with the axis thereof an angle of 20° to 30°, abut on the sole 3 before striking the inner side li, which has .the advantage of limiting the lateral displacement of the border which is maintained in place by the weight of the vehicle.

According to another embodiment, the transverse width of the sole 3 is less than about 10 cm, with the result that, in the event of a shock of a vehicle against the border, the vehicle's tire encounters the inner side li before abutting on the sole 3.

FIGS. 1 and 2 show a preferred embodiment in which the outer side le presents the form of a circular sector centred on the inner edge 5 of the sole 3. This shape makes it possible to obtain a correct alignment of the outer side despite the irregularities of the ground on which the border is laid. It suffices, at the moment of laying, to align the inner ends 5 of the various elements.

The lower edge of the outer side may present a surface 4*a* which is curved upwardly to facilitate slide of the profile on the ground or a surface perpendicular to the ground.

The inner side li presents in its upper part a curved surface 7 whose convexity is directed upwardly and towards the road, which tangentially joins the cylindrical surface 4 of the rear side and the curved surface 2 of the front side. The convex curved surface 7 bears a sliding coating 8 which is located at a distance from the ground such that the tire of a vehicle which leaves the road strikes this coating 8.

According to one embodiment, the coating 8 is a sheet or a layer of polytetrafluoroethylene or a resin of solid silicone or graphite or any other solid material having a static coefficient of friction with rubber less than 0.4.

When a vehicle accidentally leaves the road and strikes the border 1, the wheels are straightened up then they slide along the coating 8. This results in that there is no risk of the wheels of the vehicle scaling the border.

Moreover, the borders 1 slide on the ground, absorbing part of the kinetic energy of the vehicles. Finally, the front wheels, which are the driving wheels, straighten up on sliding against the coating and, in the majority of cases, the shock returns the vehicle in the direction of the axis of the highway.

By way of comparison, metallic safety rails have a static coefficient of friction with rubber greater than 0.6.

The border elements 1 shown in FIGS. 1 and 2 advantageously comprise, at their two ends, a notch 6 which allows passage of the bolts and tools necessary for fixing the elements together.

Figure 3:
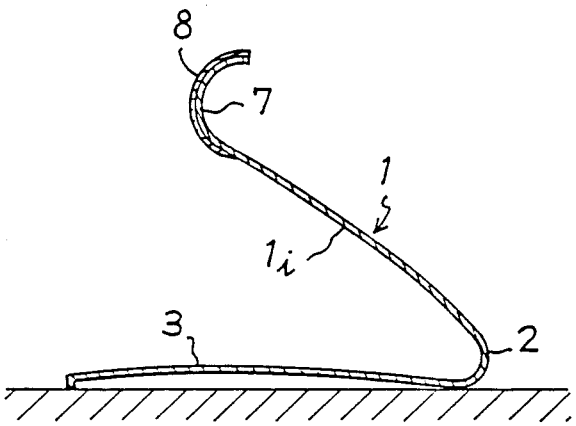
FIG. 3 is a transverse section through a variant embodiment of a metallic profile used as safety rail.

FIG. 3 shows a transverse section of a variant embodiment of a border according to the invention, which is composed of a curved metallic profile which comprises a substantially horizontal sole 3 laid on the ground, a curved surface 2 which joins the sole to an inner side li which is inclined and subatantially plane, which tangentially joins a cylindrical surface 7 whose convexity is directed towards the road and which bears on its convex outer face a sliding coating 8.

Homologous parts are represented by the same references in FIGS. 2 and 3.

Figure 4:
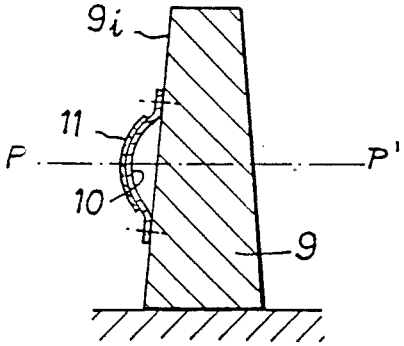
FIG. 4 shows a transverse section of a safety wall bearing a sliding coating.

FIG. 4 shows a transverse section of a highway safety barrier composed of a low wall 9 forming a continuous line bordering a road.

The wall 9 may be a wall made of concrete cast in situ or composed of prefabricated elements placed end to end. Reference **9*i*** designates the inner side, i.e. the one facing the road.

On the inner side, a metallic profile 10 is fixed, for example by bolts, expanding plugs or by any other equivalent fixing means. The profile 10 comprises a convex surface directed towards the road and this convex surface bears a sliding coating 11.

According to a preferred embodiment, the section 10 and the sliding coating 11 are symmetrical with respect to a horizontal plane PP' and the height of this plane above the ground may vary between 30 cm and 60 cm depending on whether it is desired to straighten up the wheels of a vehicle after a shock against the barrier, or solely to allow a correct slide of the bodywork of the vehicle against the sliding coating.

Figure 5:
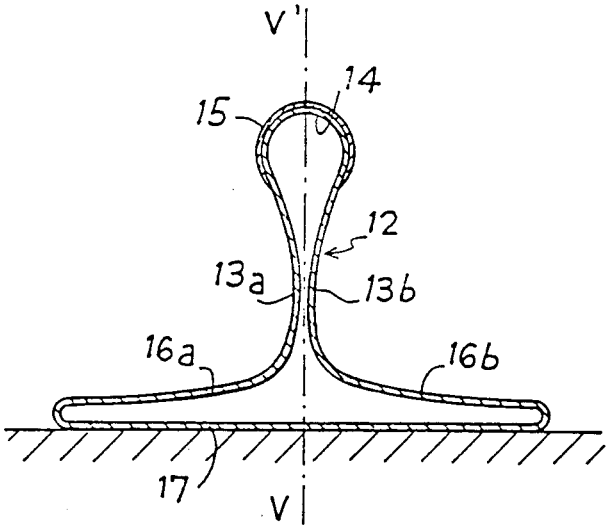
FIG. 5 is a transverse section of a metallic profile used for constructing a safety rail separating two carriageways of traffic.

FIG. 5 shows a transverse section of another embodiment of a metallic profile 12 according to the invention, intended to be placed between two carriageways of traffic in order to separate them.

Profile 12 is preferably symmetrical with respect to a vertical longitudinal plane V—V.

It comprises two lateral sides **13*a* and 13*b* of which the upper ends are connected to a cylindrical surface 14 which bears on its outer face a sliding coating 15**.

The lower ends of the lateral sides are extended by surfaces **16*a* and 16*b* slightly inclined downwardly and outwardly, which are curved inwardly to form a sole 17 placed on the ground. In this embodiment, the sliding coating 15** envelopes the whole apex and the upper end of the lateral sides.

Figure 6:
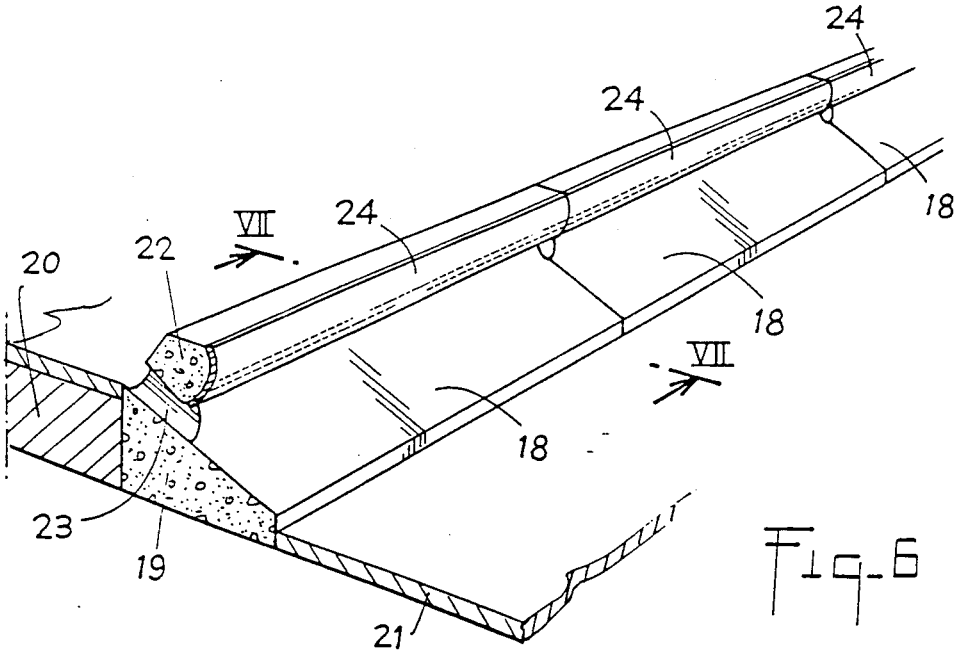
FIG. 6 is a view in perspective of a curb according to the invention.

FIG. 6 is a view in perspective of a curb composed of identical prefabricated concrete elements 18 which are placed end to end along a road.

Figure 7:
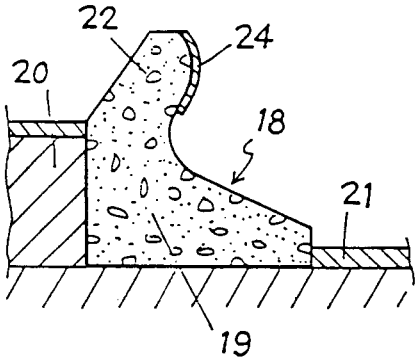
FIG. 7 is a transverse section along VII—VII of FIG. 6.

FIG. 7 is a transverse section along VII—VII of FIG. 6. Each element 18 comprises a base 19 placed on the ground or on a concrete sole between a pavement 20 and a road surfacing 21 or a gutter.

Each element further comprises a rib 22 whose height is of the order of 10 cm and placed between 20 cm and 30 cm above the highway. The inner face of this rib which is directed towards the highway presents a convex surface. Reference 23 represents water-evacuation holes. Such concrete curbs are known. In practice, when a vehicle accidentally leaves the road, the wheel often scales the curb and the vehicle passes over it as soon as the angle of incidence of the vehicle and/or the speed of the vehicle are high. This is due to the high coefficient of friction of the tire against the concrete which leads to a good adherence of the tire on the convex surface of the rib 22 when it strikes the latter.

According to the present invention, the curbs 18 are equipped with a sliding coating 24 which is disposed against the inner convex face of the rib 22. The sliding coating 24 allows the tire of the wheel which strikes it to slide longitudinally so that, for greater angles of incidence and/or higher speeds of a vehicle striking the curb, the vehicle no longer passes over said curb, but the steering is straightened up.

The sliding coating 24 may be applied on metallic profiles which are coated on the outside with a layer of polytetrafluoroethylene, silicone or graphite and which are fixed to the concrete by adhesion or seals.

In a variant, the sliding coating 24 may be a layer of a solid or pasty material which is applied directly or glued on the concrete.

Figure 8:
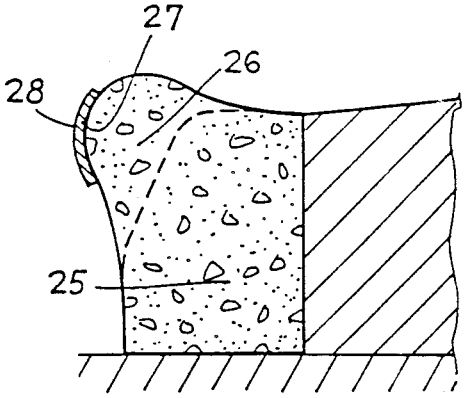
FIGS. 8 and 9 are transverse sections of variant embodiments of curbs according to the invention.
Figure 9:
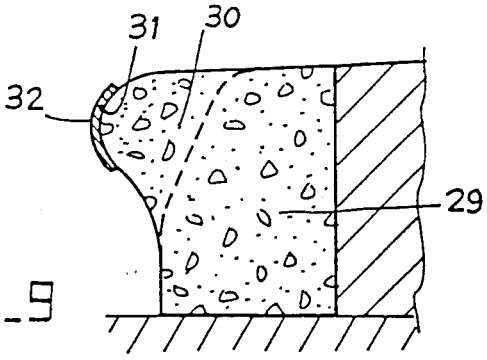

FIGS. 8 and 9 show transverse sections of pavement curbs modified according to the invention.

In these Figures, the contour of the conventional curbs are shown in dotted lines.

FIG. 8 shows an element 25 of a pavement curb without gutter which is prefabricated in concrete and which has been modified by the addition of a rib 26 in relief towards the road and upwardly, and which presents a convex surface. This rib is coated with a metallic profile 27 which bears a sliding coating 28.

FIG. 9 shows another embodiment of an element of pavement curb without gutter which is prefabricated in concrete and which has also been modified by the addition of a rib 30 which is in relief towards the road and which presents a convex surface which bears a metallic profile 31 which is coated with a sliding coating 32. In a variant, the sliding coatings 28 and 32 may be glued directly on the concrete of the curb.

The sliding coatings 28 and 32 equipping pavement curbs prevent drivers from parking their cars on the pavement, as the wheels of the vehicle slide on the sliding coating. The sliding coating 28 or 32 may advantageously be coloured yellow to indicate that parking is prohibited at that spot.

The curbs according to FIGS. 8 and 9 improve safety of pedestrians who are walking on a pavement, by preventing the vehicles from accidentally or voluntarily climbing on the pavement.

Figure 10:
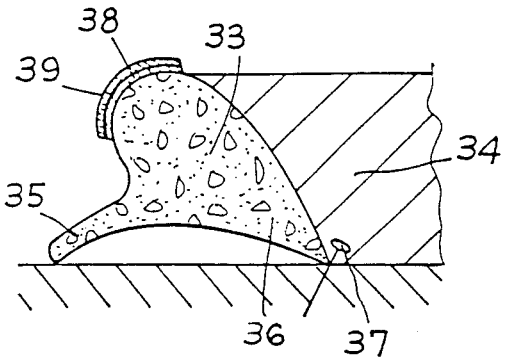
FIG. 10 is a transverse section of another embodiment of a concrete curb.

FIG. 10 is a transverse section of another embodiment of a curb element 33 prefabricated in concrete.

Such a curb may be laid in order to separate a pavement or a lateral traffic divider 34 from a road.

This element comprises a surface for abutment on the ground which presents, towards the road, a sole 35 slightly inclined towards the road and, opposite the road, a thinned part 36 which may serve as centre of rotation in the case of shock of a vehicle. Reference 37 represents a fixing means such as a nail, a peg, a metallic profile which is driven in the ground to prevent the curb from sliding.

The upper part of the curb element 33 presents a curved surface whose convexity is directed towards the road and this curved surface is equipped with a metallic profile 38 whose outer face is coated with a sliding coating 39 against which the tires of a vehicle which leaves the road strikes.

Figure 11:
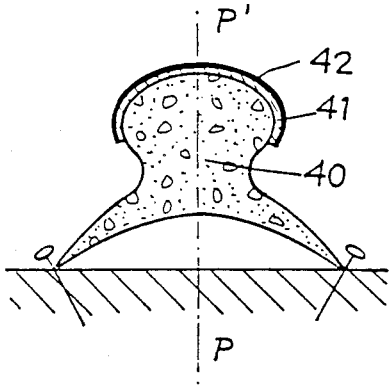
FIG. 11 is a transverse section of a concrete curb placed between two carriageways of traffic.

FIG. 11 shows an element 40 of a prefabricated concrete curb which is symmetrical with respect to a longitudinal plane PP' and which is intended to be used as median strip dividing two separate carriageways. The upper part presents a rounded shape and it is equipped with a metallic profile 41 coated on its outer face with a sliding coating 42.

In a variant, the sliding coatings 39 and 42 may be applied directly on the concrete.

Figure 12:
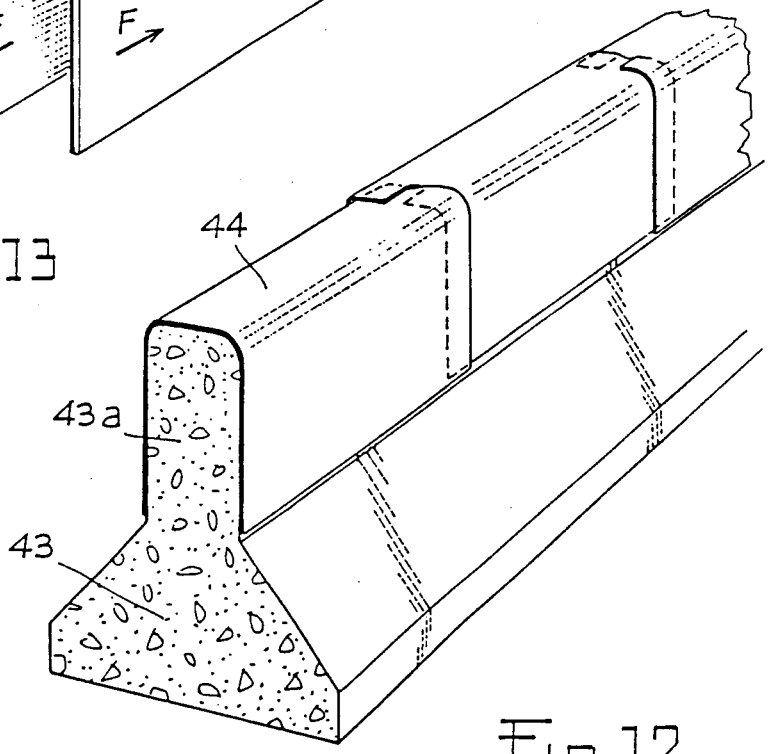
FIG. 12 is a view in perspective of a section of safety barrier made of concrete cast in situ or prefabricated.

FIG. 12 shows a section of a safety barrier 43 made of concrete having a height of the order of 80 cm. Such a barrier is generally implanted between the two carriageways of a motorway or on the side of a road with heavy-traffic. It is cast in situ by a machine with sliding form. The upper part of the barrier is in the form of a virtually vertical wall 43*a*. This wall is capped with tunnel-shaped metallic profiles 44, which overlap like tiles and which bear on their outer face a sliding coating, for example a coating of polytetrafluoroethylene or silicone. The metallic profiles 44 are fixed to the concrete by adhesion or by sealing tabs or any other equivalent fixing means.

Figure 13:
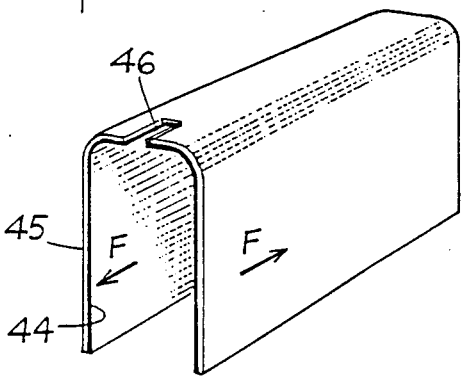
FIG. 13 is a view in perspective of one of the metallic profiles equipping a barrier according to FIG. 12.

FIG. 13 shows a view in perspective of an embodiment of a metallic profile 44 bearing a sliding coating 45. It is seen that this profile comprises at one of its ends a longitudinal notch 46 allowing the imbrication of one profile in the following, so that the profiles overlap mutually on each side of the barrier in the direction of movement of the traffic indicated by arrows F. In a variant, the sliding coating may be glued or fixed directly on the concrete barrier 43.

Safety barriers for highways are known, comprising one or more rails composed of round timber sections assembled end to end by metal pieces. However, the friction of the tires or bodywork of a vehicle against the wood is high and the instantaneous efforts that the wooden rails must support upon a shock are therefore high. One means of reducing these efforts is to facilitate slide of the vehicle against the rail by a process according to the present invention.

Figure 14:
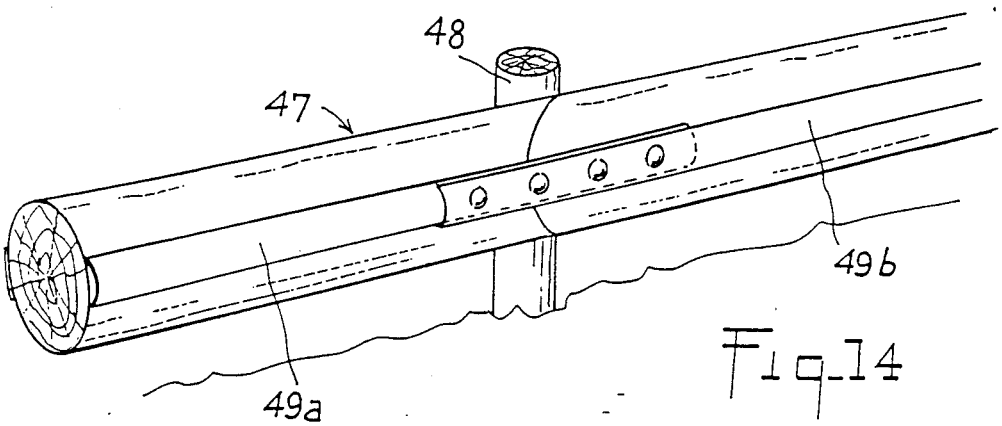
FIGS. 14 and 15 are a view in perspective and a horizontal section of a highway safety rail made of wood.

FIG. 14 is a view in perspective of a safety barrier comprising a horizontal rail 47 composed of round timber sections which are assembled end to end and mounted on wooden posts 48.

Figure 15:
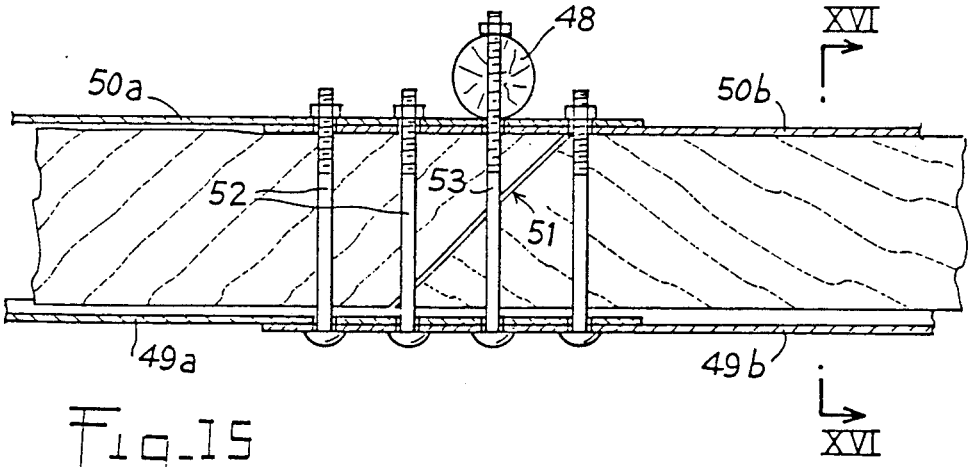

FIG. 15 is a horizontal section of FIG. 13 through the horizontal diametral plane of rail 47.

Figure 16:
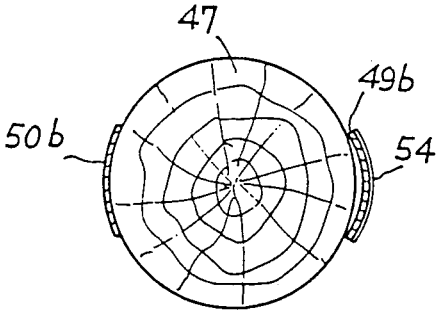
FIGS. 16 and 17 are transverse sections along XV—XV of FIG. 15.

FIG. 16 is a transverse section of the rail through plane XVI—XVI.

Figure 17:
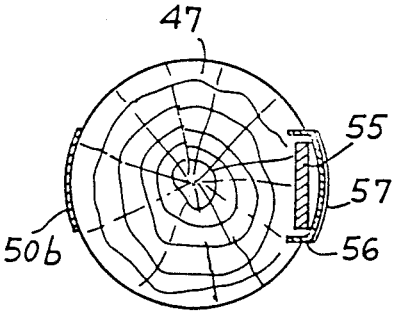

FIG. 17 is a transverse section through a variant embodiment.

These Figures show that the round timber sections are assembled end to end on the side facing the road by horizontal metallic profiles 49*a*, 49*b* which partially overlap at the join of two timber sections. Similarly, on the side opposite the road, the timber sections are assembled by horizontal metallic profiles 50*a* and 50*b* which partially overlap at the join of two sections. FIG. 15 shows that the ends of the timber sections may be cut aslant, for example at 45°, with the result that an oblique join 51 is obtained.

Thanks to the oblique joins 51, part of the efforts which are applied to a timber section upon a shock of a vehicle is transmitted to the adjacent timber sections.

At the join where profiles 49*a* and 49*b*, on the one hand, and 50*a* and 50 *b* on the other hand, overlap, assembly bolts 52 pass through one of the timber sections and the four metallic profiles. A bolt 53 also connects the posts 48 with the profile 50*b*.

According to the present invention, the profiles 49*a* and 49*b* located towards the road have a transverse section in the form of an arc of circle whose radius of curvature is slightly less than the radius of the timber sections, with the result that they are slightly in relief with respect to the outer surface of the timber, as shown in FIG. 16. The profiles 49*a*, 49*b* bear on their outer face a sliding coating 54, for example a coating of polytetrafluoroethylene or silicone.

On the other hand, the profiles 50*a* and 50*b* located on the side opposite the road bear no sliding coating. They have a radius of curvature equal to the radius of the timber sections. The profiles 50*a* and 50*b* do not necessarily extend over the whole length of the rail but may be limited to fish plates astride the joins 51.

FIG. 17 shows a variant embodiment in which the timber sections are assembled end to end by fish plates 55 made of flat iron placed in a horizontal groove which extends on either side of the join between two timber sections. In this embodiment, the rail comprises, on the road side, U-shaped metallic profiles 56, which cap the fish plates 55, of which the outer face directed towards the road bears a sliding coating 57 and which extend over the whole length of the rail.

Safety barriers may also be constructed, comprising one or more horizontal rails constituted by metallic tubes which may be of circular section or of elliptic section obtained by crushing a cylindrical tube.

Figure 18:
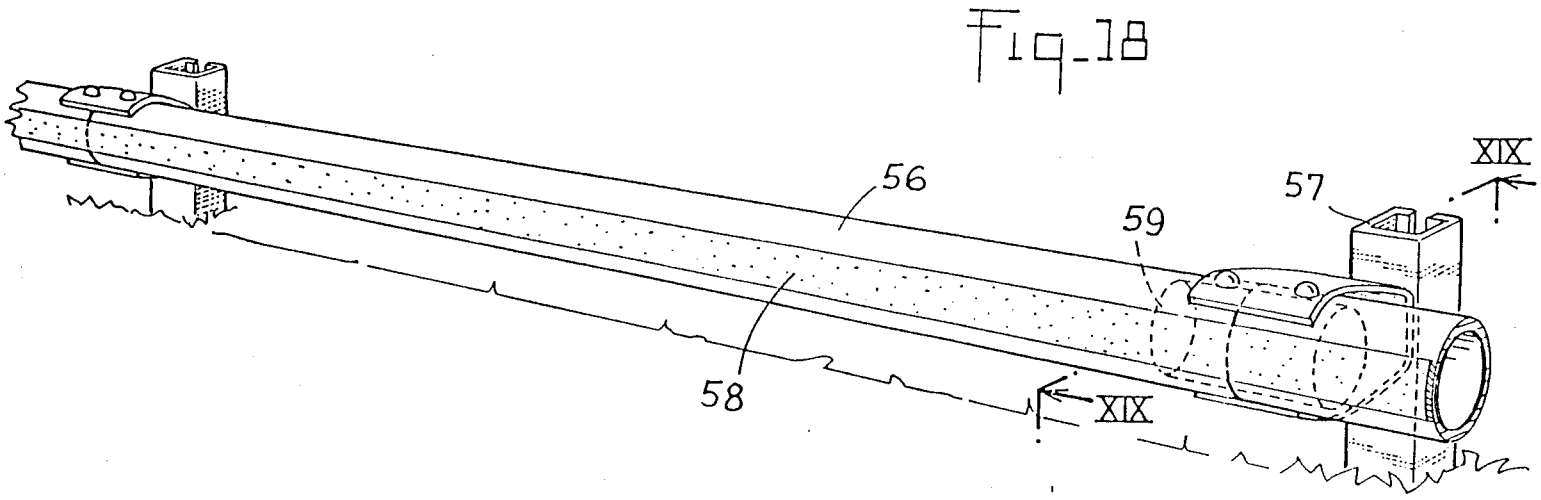
FIG. 18 is a view in perspective of a highway safety rail made of metal tubes.
Figure 19:
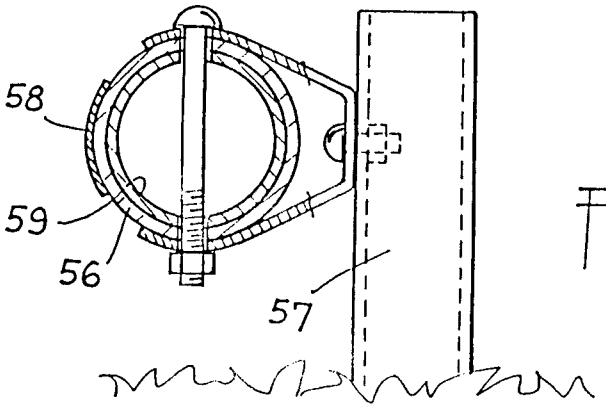
FIG. 19 is a transverse section along XIX—XIX of FIG. 18.

FIG. 18 shows a view in perspective of a safety barrier comprising a horizontal rail 56 composed of tubes which are assembled end to end by burring or by sleeve-coupling by means of sleeves 59 engaged in the tubes and which are mounted on posts 57. FIG. 19 is a transverse section of FIG. 18.

These two Figures show that the metallic rail comprises a strip of sliding coating 58 which is located along the generatrix closest to the road. The sliding coating 58 is for example a glued layer or strip of polytetrafluoroethylene or silicone or a layer of micronized graphite.

The very high bending strength and torsional strength of the metal tubes combined with the slide due to the sliding coating 58 make it possible efficiently to guide out-of-control vehicles.

Such guiding will be all the better as the wheels of the vehicle will have been straightened up at the moment of shock on the sliding coating and will continue to abut on the coating whilst sliding therealong.

In the foregoing description, sliding coatings have been given by way of preferred example, constituted by a layer of polytetrafluoroethylene, solid silicone resin or graphite applied on a metal support or a strip of these materials glued on a metallic profile. It is specified that, wherever possible, the sliding coating may also be applied directly on curbs, rails or barriers made of concrete, metal, wood or plastics material.

It is also specified that the invention is not limited to coatings composed of polytetrafluoroethylene or solid silicone resin.

According to another embodiment, the sliding coating may be composed of a paraffin wax, i.e. an alkane or a mixture of alkanes comprising a number of carbon atoms greater than 15.

These waxes melt easily and a layer of wax may therefore be melted and applied along a rail, which wax solidifies, forming a sliding film which conserves its properties in time.

According to another embodiment, pulverulent products may be used, for example micronized graphite which may be applied by simple friction on that part of the rail exposed to the shocks.

A pulverulent or granular product may also be used, presenting good qualities of slide by incorporating it in a binding agent, for example flakes of graphite or molybdenum sulfide (molybdenite) incorporated in a paint or in a grease which is applied on that part of the rail exposed to shocks.

Micro-balls or micro-spheres, for example micro-balls of glass, ceramics or plastics material, having a diameter smaller than 3 mm, may also be used, which are fixed by adhesion on that part of the rail which is exposed to the shocks of vehicles.

What is claimed is:

1. A safety device to be implanted along a road to retain vehicles thereon, said device comprising a surface to be exposed to the shocks of vehicles, and said surface bearing a sliding coating comprising a layer of paraffin comprising a solid alkane having a number of carbon atoms greater than 15.

2. A safety device to be implanted along a road to retain vehicles thereon, said device being of the type comprising a surface to be exposed to the shocks of vehicles, wherein at least a part of said surface bears a strip of a sliding coating comprising micro-balls having a diameter of less than 3 mm which are fixed by means of a binding agent to said surface.

3. A safety device to be implanted along a road to retain vehicles thereon, said device being of the type comprising metallic profiles to be placed end to end along the road to form a continuous surface parallel to the road and which is to be exposed to shocks of vehicles, said surface being upwardly curved and having a convexity to be directed towards the road and bearing a sliding coating, and said surface being adapted to be in contact with the ground.

4. A safety device to be implanted along a road to retain vehicles thereon, said device being of the type comprising a curb comprising prefabricated concrete elements, wherein said prefabricated concrete elements comprise a horizontal rib having a convex surface to be directed towards the road, which convex surface bears a sliding coating.

5. A safety device to be implanted along a road to retain vehicles thereon, said device being of the type comprising a concrete barrier to separate two carriageways of traffic, wherein said barrier comprises, in its upper part, a vertical wall which is capped by tunnel-shaped metallic profiles which mutually overlap and which bear on their outer surfaces a sliding coating.

6. A safety device to be implanted along a road to retain vehicles thereon, said device being of the type comprising safety rails comprising round timber sections assembled end to end to form a horizontal rail, wherein said round timber sections are to be assembled, on the road side, by longitudinal metallic profiles each having a surface to face towards the road, the surfaces bearing a sliding coating, which metallic profiles extend over the whole length of the rail and mutually overlap at the joins between two timber sections.

7. A safety device to be implanted along a road to retain vehicles thereon, said device being of the type comprising a horizontal rail comprising metallic tubes assembled end to end and mounted on posts, each of said tubes having a surface to face towards the road, the surfaces bearing a sliding coating forming a longitudinal strip which is located along the generatrix of the tube to be closest to the road.

8. A safety device to be implanted along a road to retain vehicles thereon, said device being of the type comprising a surface to be exposed to shocks of vehicles, wherein at least a part of said surface bears a sliding coating comprising a solid silicon resin.

9. A safety device according to any of claims 1 to 8 wherein said sliding coating is applied directly on said surface.

10. A safety device according to any of claims 1 to 8 wherein said sliding coating is applied on a face of a profile, which profile is fixed on said surface so that the coated face of said profile is directed towards the road.

* * * * *